US009988132B1

(12) United States Patent
Roberts

(10) Patent No.: US 9,988,132 B1
(45) Date of Patent: Jun. 5, 2018

(54) COMBINATION APPARATUS MADE OF SACRIFICIAL ANODE MATERIAL REMOVABLY AFFIXED TO A SHAFT OF A PROPELLER OF AN ENGINE OF A WATER CRAFT, THE APPARATUS INCLUDING REMOVABLE AND REPLACEABLE CUTTING BLADES

(71) Applicant: Ian Roberts, Simi Valley, CA (US)

(72) Inventor: Ian Roberts, Simi Valley, CA (US)

( * ) Notice: Subject to any disclaimer, the term of this patent is extended or adjusted under 35 U.S.C. 154(b) by 0 days. days.

(21) Appl. No.: 15/617,214

(22) Filed: Jun. 8, 2017

(51) Int. Cl.
*B63H 1/28* (2006.01)
*B63H 5/16* (2006.01)
*C23F 13/14* (2006.01)

(52) U.S. Cl.
CPC ..... *B63H 5/165* (2013.01); *C23F 13/14* (2013.01); *C23F 2213/31* (2013.01)

(58) Field of Classification Search
CPC ..... B63H 5/165; C23F 13/14
USPC ..... 440/73
See application file for complete search history.

(56) References Cited

U.S. PATENT DOCUMENTS

| | | | | |
|---|---|---|---|---|
| 4,938,724 | A * | 7/1990 | Shaw | B63H 5/165 416/146 R |
| 4,954,108 | A * | 9/1990 | Govan | B63H 5/165 416/146 R |
| 6,113,445 | A * | 9/2000 | Trosclair | B63H 5/165 416/146 R |
| 6,562,206 | B2 * | 5/2003 | Showcatally | B63B 59/00 204/196.23 |
| 6,675,483 | B2 | 1/2004 | Bond et al. | |
| 7,273,402 | B2 * | 9/2007 | Mullings | B63H 5/165 416/146 R |
| 8,307,553 | B2 | 11/2012 | Follo et al. | |
| 2011/0070784 | A1 * | 3/2011 | Roberts | B63B 59/00 440/73 |

* cited by examiner

*Primary Examiner* — Stephen P Avila
(74) *Attorney, Agent, or Firm* — Thomas I. Rozsa

(57) ABSTRACT

The present invention is a combination apparatus having a body with two separate mating arms made of sacrificial anode material and a pair of oppositely disposed removable cutting blades made of material such as stainless steel. A respective cutting blade extends through an interior of a respective mating arm and extends outwardly from an exterior surface of a respective mating arm with cutting teeth of each respective cutting blade aligned with a slope of the exterior surface of a respective mating arm.

8 Claims, 12 Drawing Sheets

COMBINATION APPARATUS MADE OF SACRIFICIAL ANODE MATERIAL REMOVABLY AFFIXED TO A SHAFT OF A PROPELLER OF AN ENGINE OF A WATER CRAFT, THE APPARATUS INCLUDING REMOVABLE AND REPLACEABLE CUTTING BLADES

BACKGROUND OF THE INVENTION

1. Field of the Invention

The present invention relates to the field of apparatus used in conjunction propeller shafts and propellers of water craft primarily used in salt water.

2. Description of the Prior Art

The following four patents are the closest prior art known to the inventor:

1. U.S. Pat. No. 6,562,206 issued to Showcatally on May 13, 2003 for "ANODE ASSEMBLY"
2. U.S. Pat. No. 6,675,483 issued to Bond et al. on Jan. 13, 2004 for "COMBINATION BARBECUE TOOL".
3. U.S. Pat. No. 7,273,402 issued to Mullings et al. on Sep. 25, 2007 for "MARINE MOTOR BLADE SYSTEM".
4. U.S. Pat. No. 8,307,553 issued to Follo et al. on Nov. 13, 2012 for "RAZOR CARTRIDGE".

There is a significant need for an improved apparatus to reduce corrosion of water craft propeller shafts and propellers and to better cut away objects which become entangled in the propeller shaft and propeller when the water craft is operated in water, especially salt water such as an ocean.

SUMMARY OF THE INVENTION

The present invention is a combination apparatus having a body with two separate mating arms made of sacrificial anode material and a pair of oppositely disposed removable cutting blades made of material such as stainless steel. A respective cutting blade extends through an interior of a respective mating arm and extends outwardly from an exterior surface of a respective mating arm with cutting teeth of each respective cutting blade aligned with a slope of the exterior surface of a respective mating arm.

After the two mating arms are retained together to form a donut shape, the respective interior surfaces of the mating arms are press fit retained around an exterior wall of a propeller shaft. The mating arms and the cutting teeth rotate with the propeller shaft so that the cutting teeth aligned with the slope of the exterior surface of the mating arms cut away debris so that the debris from the water will not become entangled with the propeller shaft and/or propeller. The key innovations of the present invention are removable cutting blades which extend through the mating arms and having cutting teeth aligned with the slope of the exterior surface of the mating arms made of sacrificial anode material.

After a respective cutting blade is inserted through a respective slot in each respective mating arm, the proximal or rear end of each respective cutting blade is aligned with an interior surface of a respective arm so that the interior surface of the arm is smooth for press fit retention against an exterior surface of a propeller shaft. A respective body of each respective cutting blade extends through a respective slot in the body of a respective arm and the cutting teeth extend transversely to the exterior surface of a respective arm with the above described relative slope. The two arms are fastened together and retained around a propeller shaft with the interior diameter of the combined arms slightly larger than the exterior diameter of the surface of the propeller shaft, to form a press fit retention. The two arms are press fit retained around the propeller shaft and rotate with the propeller shaft.

While the invention will primarily be described as having two separate mating arms which are retained together to form the donut shape, which arms are made of sacrificial anode material, it is also within the spirit and scope of the present invention for the two arms to be retained together at one end by a means such as a hinge so that when press fit retained around the diameter of the shaft of a propellor, it is only necessary to have one bolt to retain the two arms together since they are retained together at one end by a hinge or other rotatable mechanism by which the two arms can be separated and then rotated together and affixed together at the end remote from the hinge connection.

The propeller shaft is affixed to a propeller at one end and at its opposite end is connected to an engine of a marine vessel or water craft selected from the group consisting of small boats with an engine having a single propeller, and multi-engine boats with multiple propellers including motor boats, sail boats, yachts and ocean liners. The present invention also includes an improved design and configuration to removably affix the apparatus to an exterior surface of a propeller shaft and an improved design for removably inserting, retaining, removing and replacing cutting blades.

One problem addressed by the present invention is corrosion of the propeller shaft and propeller which are placed in water, especially saltwater, when operated with a water craft. In general, the propeller shaft and the propeller are made of expensive but corrosive material such as silicone bronze, stainless steel or Monel which is a mix of alloys.

The material out of which the body or arms of the present invention is made is selected from the group consisting of zinc, aluminum and magnesium or a mixture of sacrificial anode materials which are any combination of zinc, aluminum and magnesium. Zinc and aluminum are used for both brackish water and salt water environments. Magnesium is used for fresh water environments, but not salt or brackish water as it can be highly reactive.

Exposure to water produces corrosion of metal parts of a boat. For parts critical to the operation of the boat, which parts are kept entirely under water, especially salt water, creation of electoral currents within the metal, at least in part, causes corrosion of the metal. Repair and/or replacement due to corrosion of critical parts including the propeller shaft and propeller is expensive.

Therefore, it is one object of the present invention to include a separate object affixed to rotate with the propeller shaft to initially corrode more rapidly than the propeller shaft and the propeller, and reduce and/or slow down the progression of corrosion of the propeller shaft and propeller. Therefore, the present invention must be made of chemically active metal which is high on the Galvanic Series to corrode more rapidly and thereby serve to protect the propeller shaft and propeller.

The present invention comprises in part two halves appearing as a pair of semi-circular removably attachable bodies, each of which is generally thick and "C-shaped" and that mate with each other. When connected together, the two parts or arms form a donut shape with a flat exterior circumference and a flat interior circumference forming a circular opening having a diameter slightly larger than a corresponding diameter of an exterior surface of a propeller shaft to enable the two arms to be press fit onto the propeller shaft and rotate concurrently with the propeller shaft.

Since the two parts of the present invention are made of either zinc, aluminum or magnesium or any combination of sacrificial anode materials of zinc and aluminum, zinc and magnesium, aluminum and magnesium, and zinc aluminum magnesium or other strong durable metals high on the Galvanic Scale, the two mating parts will corrode faster than the propeller shaft to which the two mating parts are press-fit retained, and corrode faster than the propeller to which the propeller shaft is attached.

Another problem encountered by the propeller shaft and propeller is entanglement with debris from the ocean water or lake water and/or plants, fishing lines and fishing nets from the same boat or from careless operators of another boat (jointly described as "Entangling Debris"). When sufficient Entangling Debris has ensnared the propeller shaft and propeller, the propeller shaft and propeller are unable to rotate and a person must dive under the boat to cut the Entangling Debris loose or the boat must be towed to a location where the Entangling Debris is removed.

In some prior art products, the cutting blades are non-removably affixed or otherwise incorporated into the body. In other prior art, the cutting blades are perpendicular to the body and affixed above or below the exterior generally cylindrical-shaped body. Therefore, if one of the cutting blades is damaged or broken, the entire product including the two arms of the body must be discarded and entirely replaced.

A key difference between the present invention and the prior art is a plurality of slots which extend through the mating arms made of sacrificial anode material to enable the flat cutting blades to be inserted into and extend through a respective slot so that the proximal end of each cutting blade is aligned with the combined interior surface of the two arms and the cutting teeth of the cutting blades extend outwardly from the circumferential exterior surface of the two arms. The cutting teeth extend through the interior body and outwardly of and perpendicular to the exterior circumference of the two arms and are aligned with an imaginary slope of the circumferential exterior surface of the two arms.

It has been discovered that if the cutting blades are perpendicular or at an angle relative to the direction of rotation of the exterior surface of the two arms, then the cutting blades may still become enveloped or surrounded by Entangling Debris.

It has been discovered by the present inventor after performing numerous experiments, that if the cutting blades are removably retained within the pair of arms and have the cutting teeth extend outwardly from the exterior circumferential surface and aligned so that the cutting teeth of the cutting blades are aligned with an imaginary straight line from the exterior surface of the two arms to the aligned portion of the cutting teeth, then the cutting teeth move in alignment with the rotation of the two arms and will effectively cut away any Entangled Debris and will not be enveloped or caught into and surrounded by the Entangled Debris.

It is therefore a key object of the present invention to provide a smooth transition from the sidewall of the two arms made of sacrificial anode material to the nearest portion of the cutting teeth so that as the propeller shaft rotates when the engine to which it is attached is turned on, the pair of arms which are press fit retained on the exterior wall of the propeller shaft rotates with the propeller shaft and the cutting blades also rotate with the two arms so that there is a smooth transition between the angle of the slope of the exterior circumferential surface of the two arms and the angle of the cutting teeth so that the cutting teeth will provide a smooth cut without snagging of the cutting teeth on any portion of the Entangling Debris.

It is a further object of the present invention to form two arms made of chemically active metal high on the Galvanic Scale such as zinc, aluminum or magnesium or mixed combinations of zinc, aluminum and magnesium and any combination of the materials. The two arms which are made of sacrificial anode material are formed in a generally donut shape with a flat circumferential outer surface and a flat circumferential inner surface surrounding an interior opening sized to be press fit retained onto a propeller shaft.

It is also an object of the present invention to form the apparatus in two mating identical arms with each arm formed in a thick C-shaped semi-circle having oppositely disposed flat surfaces at the respective ends of the semi-circular shape. For each arm, a smooth opening extends from one flat side surface on an interior side of the arm, extending within the body of the arm and opening to an/aligned recess in the body of the arm extending from the opening to the exterior of the body.

In addition, for each arm, an extension in a smooth opening is inserted into a recess in a threaded opening. In each case, the smooth opening extends from a recess in the exterior wall to a flat surface in the interior wall and has an extension extending from it and the threaded opening extends from a separate recess in the exterior wall and ends at the location of a recess in the flat wall so that the extension from the smooth opening is inserted into the recess in the threaded opening. Alternatively, instead of having two separate arms, the alternative embodiment can have one end of the two arms hingeably attached together which would mean that there would only be one set of smooth openings with an extension and an alternative opening with a recess into which a single bolt would be threaded into the two arms to retain them together.

In addition, each arm has a slotted opening extending from a proximal end aligned with the interior circumference, through the body and exiting at a distal end aligned with the exterior circumference. The slot can be positioned anywhere, but preferably is located at the center of the arm and equidistant between the two openings in the arm. A cutting blade is inserted through the slot and is sized so that the cutting teeth extend outwardly away from the exterior circumferential wall of the arm with the cutting teeth at the desired slope angle as discussed above.

The present invention apparatus made of sacrificial anode material is removably affixed to an exterior wall of a propeller shaft of a propeller of an engine of a boat used in water and including removable and replaceable cutting blades. Two arms are placed together and aligned so that recess of a threaded opening in the first arm is aligned with and receives an extension of a smooth opening in the second arm and a recess of a threaded opening in the second arm is aligned with and receives an extension of a smooth opening in the first arm. A first mating threaded bolt is extended through the smooth opening in the first arm and threaded into the threaded opening in the second arm. A second mating threaded bolt is extended through the smooth opening in the second arm and threaded into the threaded opening in the first arm to secure the two arms together.

In operation, a first arm is placed onto the propeller shaft so that half of the exterior wall of the propeller shaft rests within the semi-circular interior opening and against the semi-circular interior surface of the first arm. The second arm is placed onto the propeller shaft so that half of the exterior wall of the propeller shaft rests within the semi-circular interior opening and against the semi-circular interior surface of the second arm. The second arm is aligned with the first arm and the two arms are fastened together to form a press fit onto the exterior wall of the propeller shaft. Once the engine is started, the propeller shaft rotates, the press fit body of the two arms made of sacrificial anode material rotates in the same direction as the propeller shaft and the aligned cutting teeth of cutting blades extending in opposite directions from the exterior surface cut away any Entangling Debris without snagging on the Entangling Debris.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated.

DETAILED DESCRIPTION OF THE EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1A:
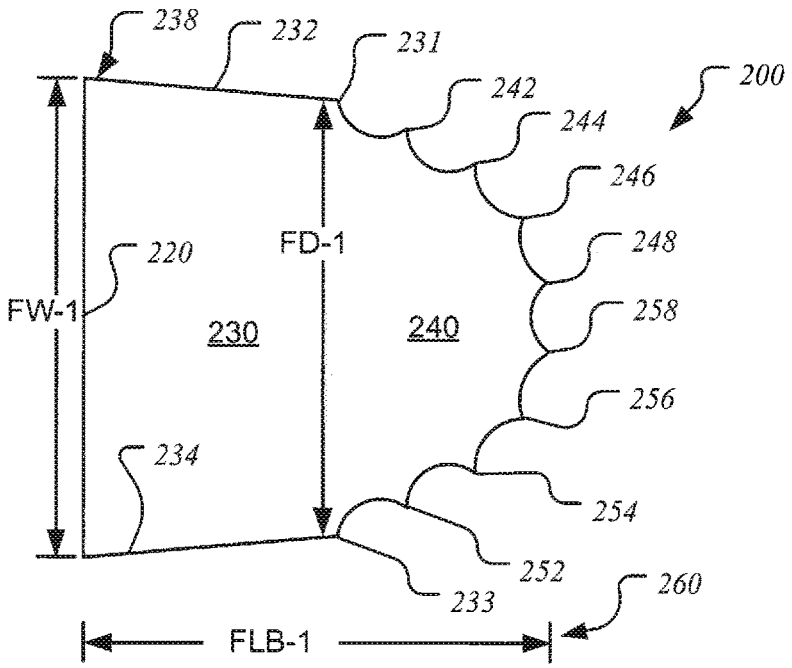
FIG. 1A is a top plan view of a first cutting blade.
Figure 2:
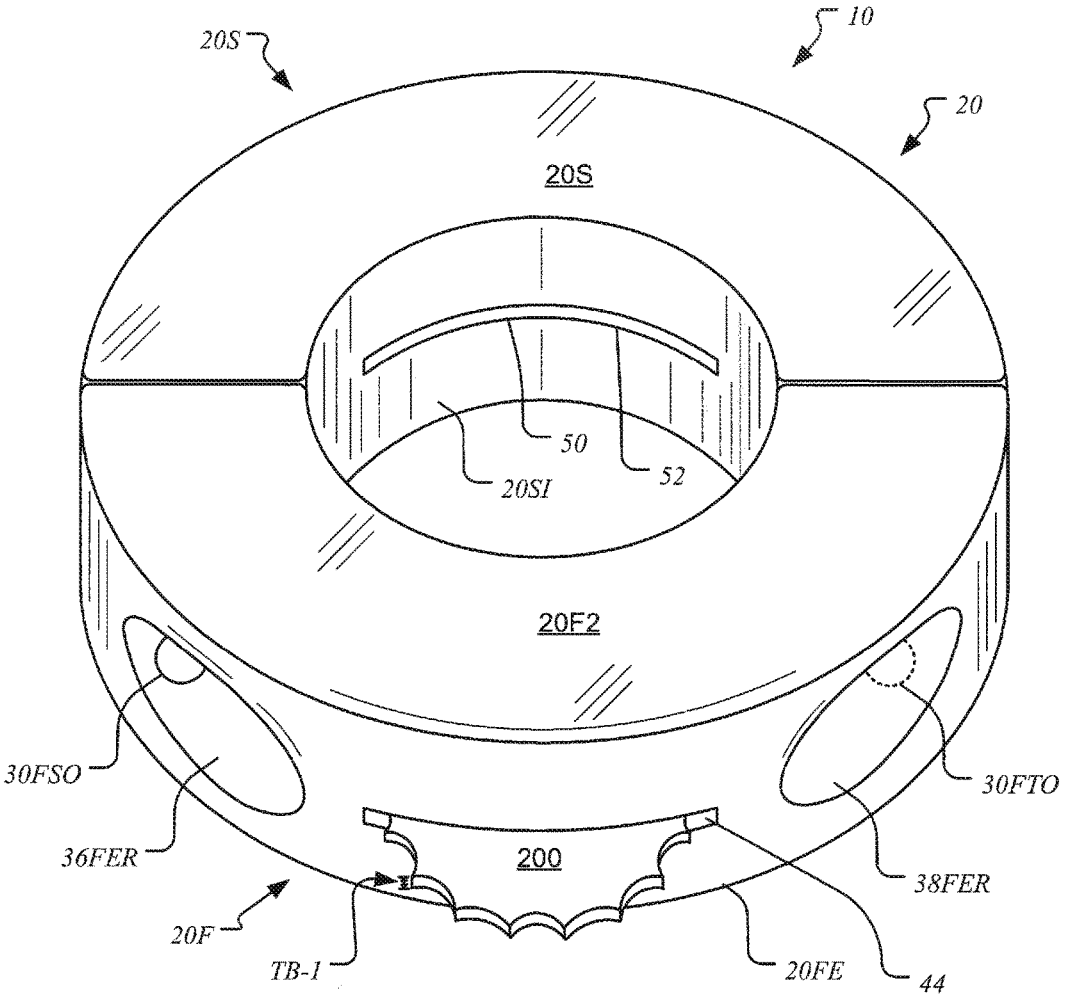
FIG. 2 is a top-side perspective view of the assembled present invention apparatus having a body made of sacrificial anode material and illustrating a first recess leading to a smooth opening, the teeth of the first cutting blade extending away from the exterior circumferential surface of the first arm and a second recess leading to a first threaded opening and illustrating a second slot in an interior circumferential surface of a second arm through which the opposite second cutting blade will be inserted.

Referring to FIG. 1A, there is illustrated a top plan view of a first cutting blade 200. The first cutting blade 200 is flat with a uniform thickness "TB-1" as illustrated in FIG. 2. By way of example only, the thickness TB-1 can be from one-sixteenth (1/16) inch to three sixteenths (3/16) inch. The cutting blade has a total length "FLB-1" from its proximal end 220 to its distal end 260, with a flat top surface 230 and a flat bottom surface 238. The proximal end 220 has first width "FW-1" and is flat or uniform along its thickness and width. The first cutting blade 200 begins having width "FW-1 and extends at spaced apart sidewalls, first sidewall 232 and second sidewall 234, each having a gradual inward slope to a respective distal end 231 and 233 spaced apart by a second distal width "FD-1". The sidewall extends for approximately half of the first cutting blade's total length FLB-1 with spaced apart first sidewall 232 and second sidewall 234 extending to a teeth section 240 having a multiplicity of first side teeth 242, 244, 246 and 248 and second side teeth 252, 254, 256 and 258. The initial first side tooth begins at the distal end 231 of first sidewall 232 with an inwardly concave slope to its tip 242 with each tooth continuing with an inward concave slope to its next tip or tooth 244. The second side teeth are mirror images of the first side teeth with initial second side teeth beginning at the distal end 233 of second sidewall 234 with an inwardly concave slope to its tip 252 with each tooth continuing with an inward concave slope to its next tip or tooth 254. The outermost teeth 248 and 258 form the distal end 260. The total length FLB-1 can be from three-quarter (¾) inch to one and one-half (1½) inches.

Figure 1B:
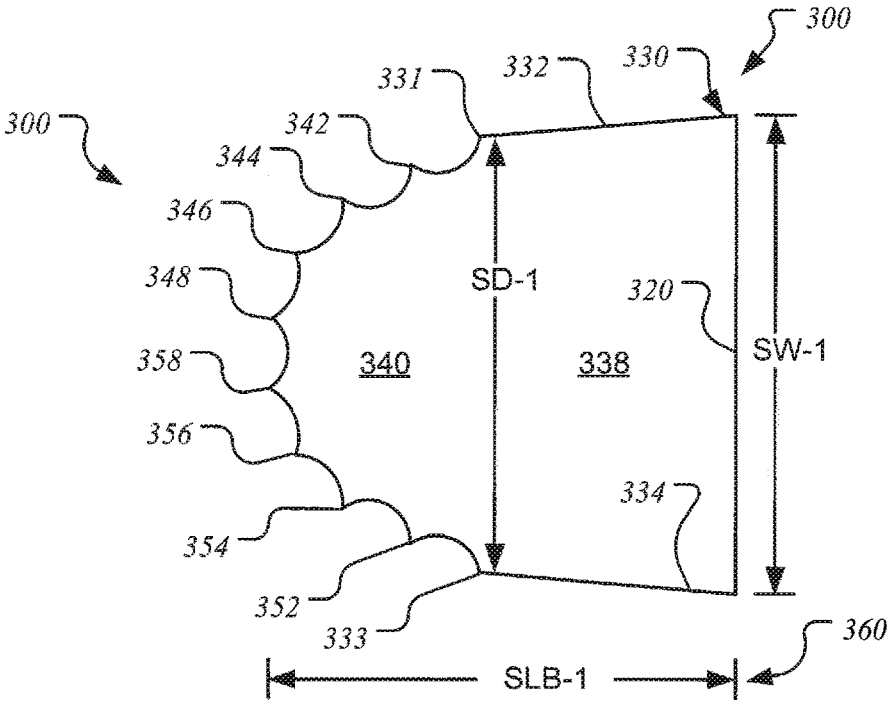
FIG. 1B is a bottom plan view of a second cutting blade.

Referring to FIG. 1B, there is illustrated a bottom plan view (flipped 180 degrees from FIG. 1) of the second cutting blade 300. The second cutting blade is identical to the first cutting blade but is illustrated from a bottom view. The second cutting blade 300 is flat with a uniform thickness which is the same thickness as the first cutting blade'TB-1", By way of example only, the thickness of the second cutting blade can also be from one-sixteenth (1/16) inch to three sixteenths (3/16) inch. The cutting blade has a total length "SLB-1" from its proximal end 320 to its distal end 360, with a flat top surface 330 and a flat bottom surface 338. The proximal end 320 has first width "SFW-1" and is flat or uniform along its thickness and width. The second cutting blade 300 begins having width "SW-1 and extends at spaced apart first sidewall 332 and second sidewall 334, each having a gradual inward slope to a respective distal end 331 and 333 spaced apart by a second distal width "SD-1". The sidewall extend for approximately half of the second cutting blade's total length SLB-1 with spaced parallel first sidewall 332 and second sidewall 334 extending to a teeth section 340 having a multiplicity of first side teeth 342, 344, 346 and 348 and second side teeth 352, 354, 356 and 358. The initial first side tooth begins at the distal end 331 of first sidewall 332 with an inwardly concave slope to its tip 342 with each tooth continuing with an inward concave slope to its next tip or tooth 344. The second side teeth are mirror images of the first side teeth with initial second side tooth beginning at the distal end 333 of second sidewall 334 with an inwardly concave slope to its tip 352 with each tooth continuing with an inward concave slope to its next tip or tooth 354. The outermost teeth 348 and 358 form the distal end 360. The total length SLB-1 can be from three-quarter (¾) inch to one and one-half (1½) inches.

Figure 7:
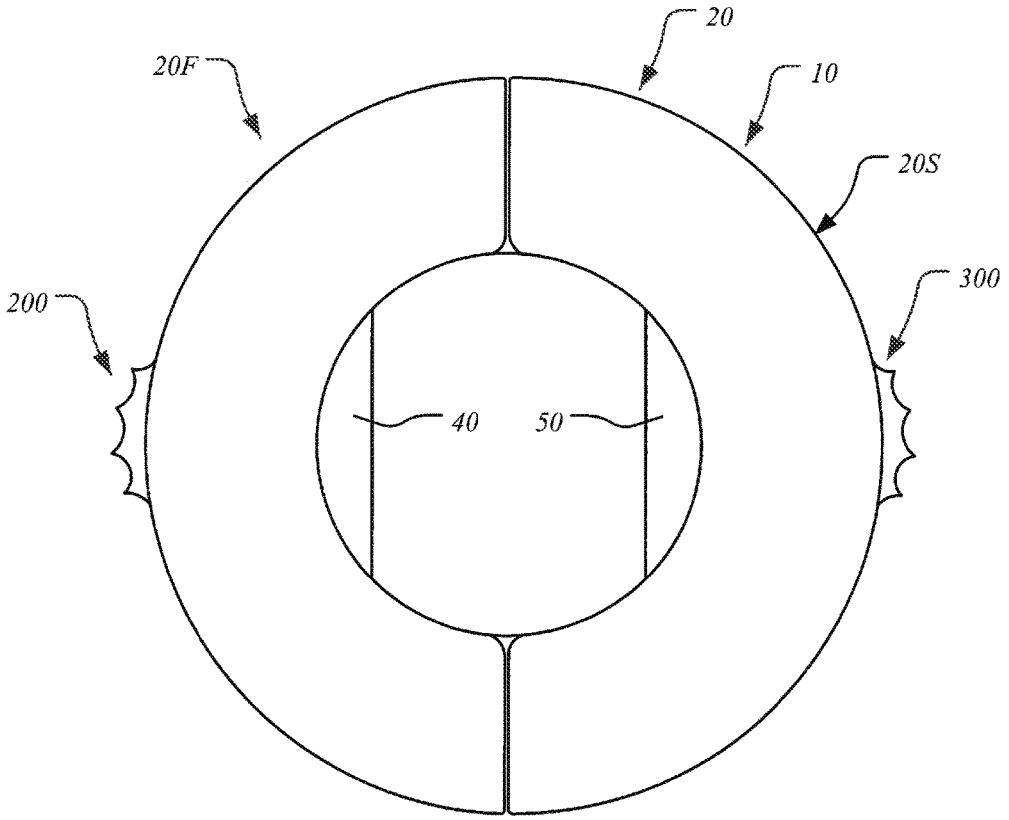
FIG. 7 is a top plan view of the assembled present invention apparatus having a body made of sacrificial anode material illustrating a portion of both cutting blades partially inserted in the body, the first arm to the left and the second arm to the right.
Figure 8:
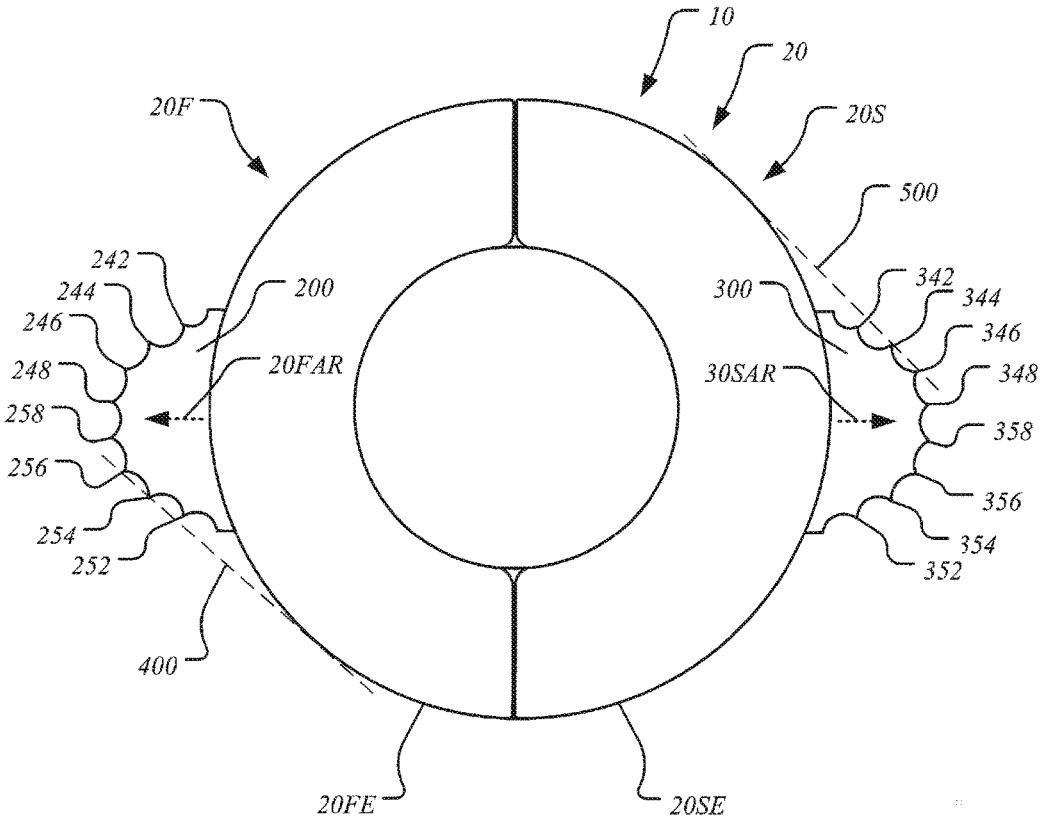
FIG. 8 is a top plan view of the assembled present invention apparatus having a body made of sacrificial anode material and illustrating both cutting blades entirely inserted in the body with the cutting teeth extending away from the body with an arrow in each cutting blade pointing in the direction the cutting blade was pushed after insertion and two straight imaginary lines drawn in dashed lines presented for illustrative purposes, the first arm to the left and the second arm to the right.

Referring to FIG. 2, there is illustrated a top-side perspective view of the assembled present invention apparatus 10 having a body 20 made of sacrificial anode material and illustrating the teeth of the first cutting blade 200 extending away from the exterior circumferential surface 20FE of the first arm 20F and illustrating a second slot 50 in an interior circumferential surface 20SI of a second arm 20S, through which the opposite second cutting blade 300 is inserted, as illustrated in FIGS. 7 and 8.

There are four (4) exterior recesses, two in the first arm 20F and two in the second arm 20S. In FIG. 2, there is illustrated the two exterior recesses extending inwards from exterior circumferential wall 20FE. Referring to FIG. 2, first exterior recess 36FER extends to a first smooth opening 30FSO and second exterior recess 38FER extends to a first threaded opening 30FTO. For purposes of discussing exterior recesses, referring to FIG. 3, the exterior surface 20SE of second arm 20S which is rotated 180 degrees clockwise from the view of the second arm illustrated in FIG. 2, illustrates third exterior recess 36SER extending to a second smooth opening 30SSO and a fourth exterior recess 38SER leading to second threaded opening 30STO.

Figure 4:
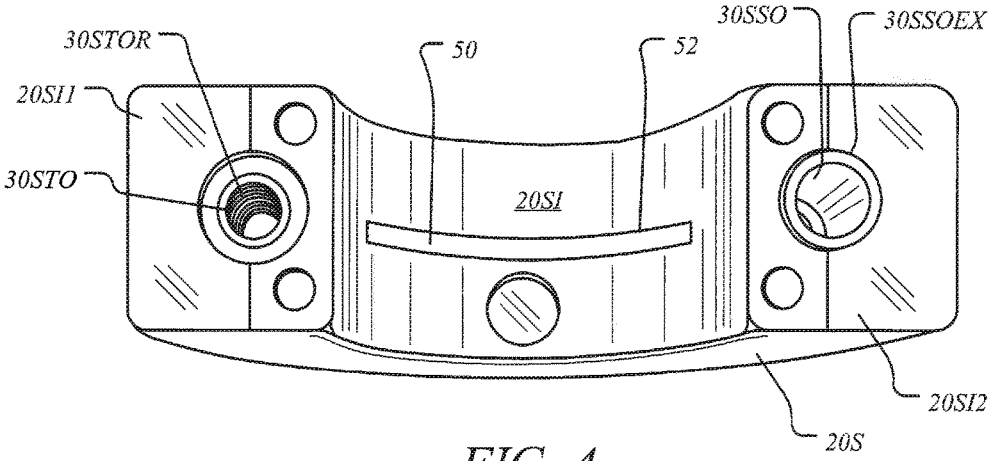
FIG. 4 is an exterior view of the second arm illustrating a third recess extending to a second threaded opening, an exterior opening of a second slot and a fourth recess extending to a second smooth opening.
Figure 5A:
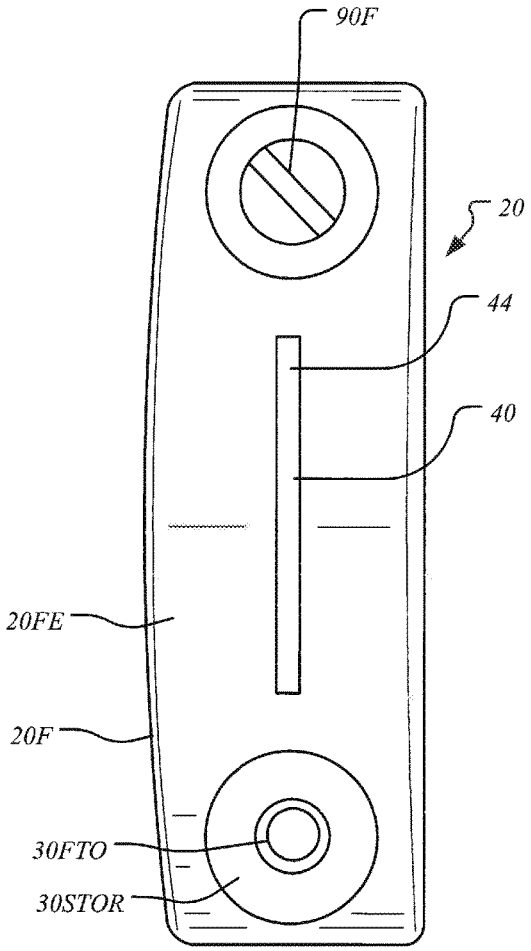
FIG. 5A is an exterior side view of the first arm illustrating the top of a first threaded bolt, an exterior of a first slot, and a first threaded opening.
Figure 5B:
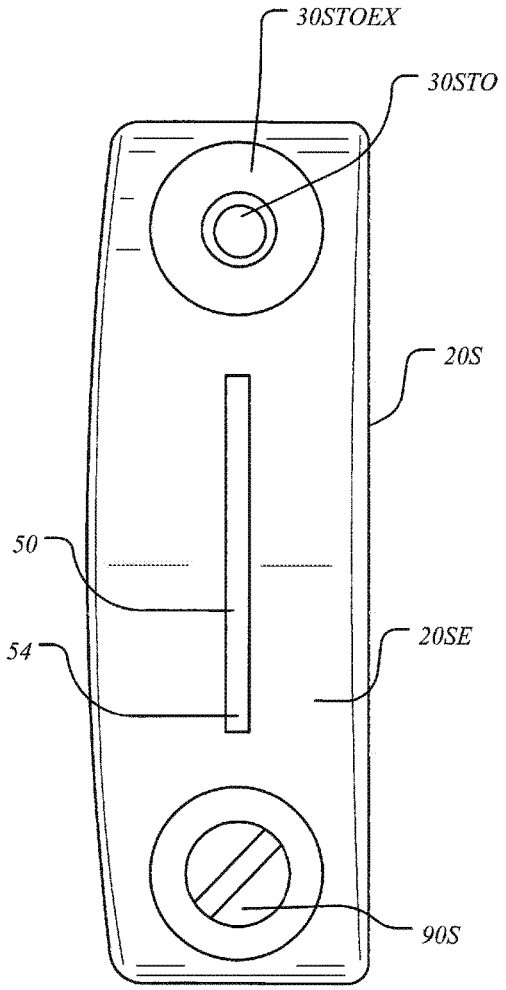
FIG. 5B is an exterior side view of the exterior of the second arm illustrating the second threaded opening with a second recess, an exterior of a second slot and top of a second threaded bolt.
Figure 6A:
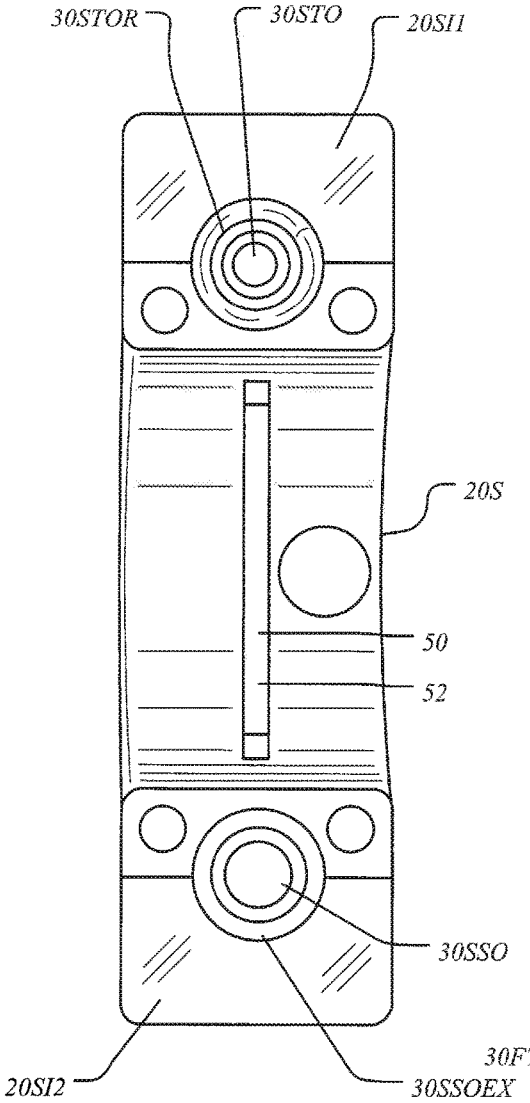
FIG. 6A is an interior side view of the second arm illustrating the second threaded opening with a second recess, an interior opening of the second slot, and second smooth opening with a second recess.

Referring to FIGS. 4, 5A, 5B, 6A and 6B, there is illustrated the interior of second arm 20S matching the perspective view of the second arm 20S illustrated in FIG. 2. The second threaded opening 30STO extends to its interior threaded opening with second interior recess 30STOR in first interior flat surface 20SI1. On the opposite side, second smooth opening 30SSO with second extension 30SSOEX (see FIG. 6A) extends from second interior flat surface 20SI2. As will be described, a first threaded mating bolt 90F extends through first smooth opening 30FSO and is threaded into second threaded opening 30STO. An interior recess (not shown) comparable to 30STOR receives second extension 30SSOEX to facilitate a secure contact. Similarly, a second mating bolt 90S extends through second smooth opening 30SSO and is threaded into first threaded opening 30FTO. First threaded opening 30FTO (as illustrated in FIG. 6A) has a recess 30FTOR (as illustrated in FIG. 6A) comparable to 30STOR receiving extension 30SSOEX. In this way, the two arms are fastened together. Remaining components of the arms will be discussed in FIGS. 2 through 9.

Figure 3:
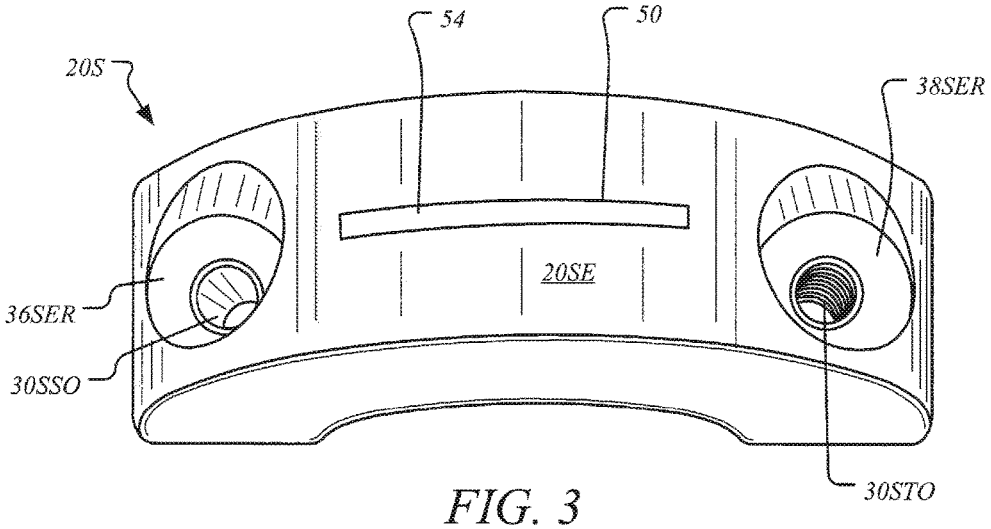
FIG. 3 is a front view of the second arm illustrating a first recess extending to a first smooth opening, an exterior opening of a first slot and a second recess extending to a first threaded opening.

Referring to FIG. 3, there is illustrated an exterior view of the second arm 20S illustrating the third recess 36SER extending to a second smooth opening 30SSO, an exterior opening 54 of a second slot 50 and a fourth recess 38SER extending to a second threaded opening 30STO.

Referring to FIG. 4, there is illustrated an interior view of the second arm 20S illustrating the second threaded opening 30STO, an interior opening 52 of a second slot 50 and second smooth opening 30SSO.

Referring to FIG. 5A, there is illustrated an exterior side view of the first arm 20F illustrating the top of a first threaded bolt 90F, an exterior 44 of a first slot 40, and a first threaded opening 30FTO and second recess 30SSOR.

Referring to FIG. 5B, there is illustrated an exterior side view of the exterior of the second arm 20S illustrating the second threaded opening 30STO, an exterior 54 of a second slot 50 and a top of a second threaded bolt 90S.

Referring to FIG. 6A, there is illustrated an interior side view of the second arm 20S illustrating the second threaded opening 30STO with a second recess 30STOR on flat surface 20SI1, an interior opening 52 of the second slot 50, and second smooth opening 30SSO with a second extension 30SSOEX on second flat surface 20SI2.

Figure 6B:
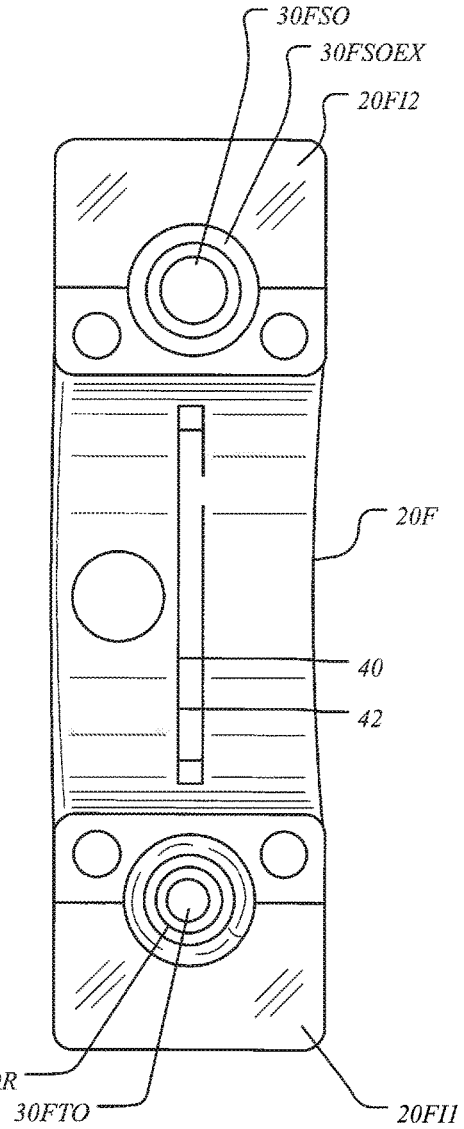
FIG. 6B is an interior side view of the first arm illustrating the first threaded opening with a first recess, an interior opening of the first slot and a first smooth opening with a first extension.

Referring to FIG. 6B there is illustrated an interior side view of the first arm 20F illustrating the first threaded opening 30FTO with a first recess 30FTOR on flat surface 20FI1, an interior opening 42 of the first slot 40, and first smooth opening 30FSO with a first smooth extension 30FSOEX on flat surface 20FI2.

Referring to FIG. 7, there is illustrated a top plan view of the assembled present invention apparatus 10 having a body 20 made of sacrificial anode material and illustrating a portion of both cutting blades 200 and 300 partially inserted through respective slots 40 and 50 of the first arm 20F to the left and the second arm 20S to the right.

Referring to FIG. 8, there is illustrated a top plan view of the assembled present invention apparatus 10 having a body 20 made of sacrificial anode material and respectively illustrating both cutting blades 200 and 300 respectively entirely inserted in the first arm 20F and second arm 20S with the cutting teeth 242, 244, 246, 248, 252, 254, 256, and 258 extending away from first arm 20F with an arrow 20FAR in the first cutting blade 200 pointing in the direction the cutting blade 200 was pushed after insertion through slot 40 (see FIG. 6A) and a straight imaginary line 400 drawn in dashed lines presented for illustrative purposes to show the slope from the exterior surface 20FE of first arm 20F to the nearest cutting teeth 254 and 256 of the first cutting blade 200, and cutting teeth 342, 344, 346, 348, 352, 354, 356, and 358 extending away from second arm 20S with an arrow 30SAR in the second cutting blade 300 pointing in the direction the cutting blade 300 was pushed after insertion through slot 50 (see FIG. 6A) and a straight imaginary line 500 drawn in dashed lines presented for illustrative purposes to show the slope from the exterior surface 20SE of second arm 20S to the to the nearest cutting teeth 344 and 346 of the second cutting blade 300.

Figure 9:
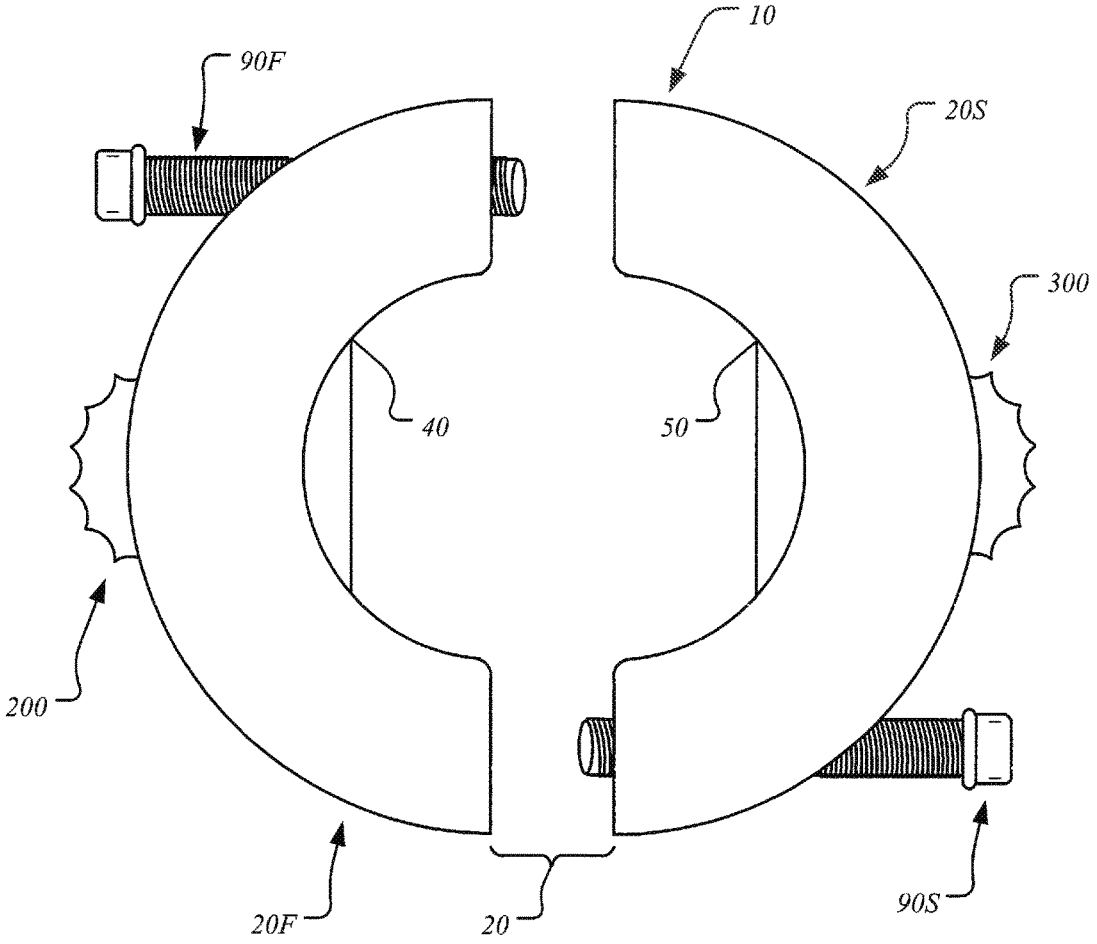
FIG. 9 is a top plan exploded view of the present invention apparatus having a body made of sacrificial anode material and illustrating both cutting blades partially inserted in the body with the cutting teeth extending away from the body, a first mating bolt extending through a portion of the first arm and a second mating bolt extending through a portion of a second arm.

Referring to FIG. 9 there is illustrated is a top plan exploded view of the present invention apparatus 10 having a body 20 made of sacrificial anode and illustrating both cutting blades 200 and 300 partially inserted through respective slots 40 and 50 respectively in the first arm 20F and the second arm 20S with respective cutting teeth extending away from the first arm 20F and the second arm 20S as described in detailed in FIG. 8, with a first mating bolt 90F extending through a portion of the first arm 20F and a second mating bolt 90S extending through a portion of a second arm 20S.

Referring to FIGS. 2 through 8, the first arm 20F has a slotted opening 40 extending from a proximal end 42 aligned with the interior circumference 20FI of first arm 20F, through the body and exiting at a distal end 44 aligned with the exterior circumference 20FE of the first arm 20F. The slot 40 can be positioned anywhere but preferably is located at the center of the first arm 20F and equidistant between the two openings in the arm. A first cutting blade 200 is inserted through the proximal end 42 of slot 40 slot and is sized so that the cutting teeth 242, 244, 246, 248, 252, 254. 256, and 258 extend outwardly away from the exterior circumferential wall 20FE of the first arm 20F with the cutting teeth at the desired slope angle as described in FIG. 8.

Similarly, referring to FIGS. 2 through 8, the second arm 20S has a slotted opening 50 extending from a proximal end 52 aligned with the interior circumference 20SI of second arm 20SF, through the body and exiting at a distal end 54 aligned with the exterior circumference 20SE of the second arm 20S. The slot 50 can be positioned anywhere but preferably is located at the center of the second arm 20S and equidistant between the two openings in the arm. A second cutting blade 300 is inserted through the proximal end 52 of slot 50 slot and is sized so that the cutting teeth 342, 344, 346, 348, 352, 354, 356, and 358 extend outwardly away from the exterior circumferential wall 20SE of the second arm 20S with the cutting teeth at the desired slope angle as described in FIG. 8.

Figure 10:
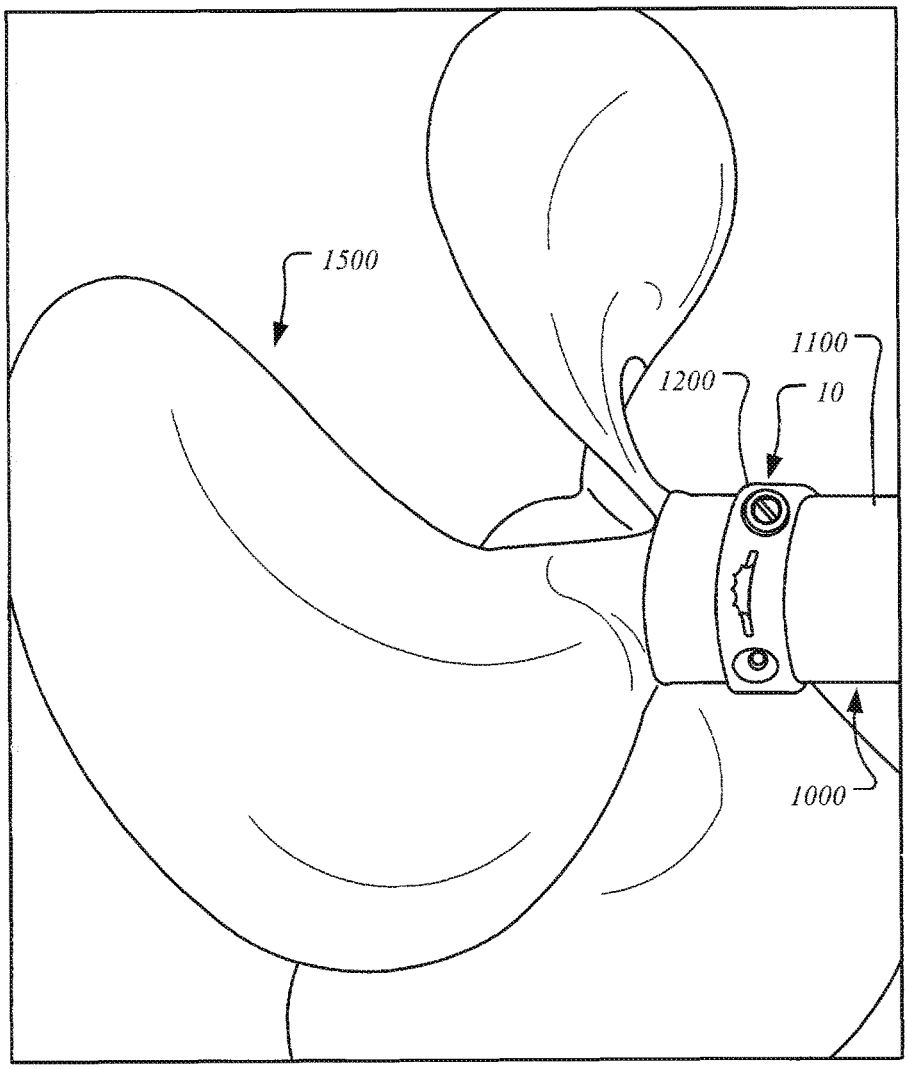
FIG. 10 is a side perspective view of the assembled present invention apparatus having a body made of sacrificial anode material press fit retained onto a propeller shaft connected to a propeller.

Referring to FIG. 10, there is illustrated a side perspective view of the assembled present invention apparatus 10 having a body made of sacrificial anode material press fit retained onto an exterior wall 1100 of a cylindrical-shaped propeller shaft 1000 connected at one end 1100 to a propeller 1500.

The present invention apparatus 10 made of sacrificial anode material is removably affixed to the exterior surface 1100 of a cylindrical-shaped propeller shaft 1000 of a propeller 1500 of an engine of a boat used in water and includes removable and replaceable cutting blades. The two arms 20F and 20S are separated. The first cutting blade 200 is inserted into the proximal end 42 of first slot 40 in first arm 20F and is pushed through slot 40 until the proximal end 220 is aligned with interior circumferential wall 20FI and the distal end 260 extends through the distal end 44 of slot 40 with the cutting teeth 242, 244, 246, 248, 252, 254, 256 and 258 extending away from the exterior circumferential surface 20FE. Similarly, the second cutting blade 300 is inserted into the proximal end 52 of second slot 50 in second arm 20SF and is pushed through slot 50 until the proximal end 320 is aligned with interior circumferential wall 20SI and the distal end 360 extends through the distal end 54 of slot 50 with the cutting teeth 342, 344, 346, 348, 352, 354, 356 and 358 extending away from the exterior circumferential surface 20SE. The smooth opening in the first arm is aligned with and receives an extension of a threaded opening in the second arm and a recess of a smooth opening in the second arm is aligned with and receives an extension of a threaded opening in the first arm. A first mating threaded bolt is extended through the smooth opening in the first arm and threaded into the threaded opening in the second arm. A second mating threaded bolt is extended through the smooth opening in the second arm and threaded into the threaded opening in the first arm to secure the two arms together.

In operation, the first arm 20F is placed onto the exterior surface 1100 of propeller shaft 1000 so that half of the exterior wall of the propeller shaft rests within the semi-circular interior opening and against the semi-circular interior surface 20FI of the first arm 20F. The second arm 20S is placed onto the exterior surface 1100 of propeller shaft 1000 so that half of the exterior wall of the propeller shaft rests within the semi-circular interior opening and against the semi-circular interior surface 20SI of the second arm 20S. The second arm 20S is aligned with the first arm 20F so that the first extension 30FSOEX of the first smooth opening 30FSO is inserted into the second recess 30STOR (see FIG. 6A) of the second threaded opening 30STSO and the second extension 30SSOEX of second smooth opening 30SSO is inserted into first recess 30FTOR of second threaded opening 30STOR (see FIG. 6B). A first mating threaded bolt 90F is inserted into first smooth opening 30FIQ through first smooth opening 30FIO and threaded into second threaded opening 30STO. Similarly, a second mating threaded bolt 90S is inserted into second smooth opening 30SSO and extends through second smooth opening 30SSO and is threaded into first threaded opening 300STO. The two arms 20F and 20S are press fit retained onto the exterior surface 1100 of propeller shaft 1000. As the propeller shaft 1000 rotates when an engine to which it is connected turns on, then the two arms 20F and 20S of the body 20 of the present invention apparatus 10 rotate with the propeller shaft. The sacrificial anode material of the body 20 corrodes faster than the propeller shaft to reduce corrosion of the propeller shaft. The cutting teeth of the cutting blades are respectfully aligned with the respective exterior circumferences 20FE and 20SE of the two arms 20F and 20S, the cutting teeth extending from within the respective arms with the cutting teeth slope aligned with respective exterior surfaces of the two arms as previously described to cut away any Entangling Debris.

If one of the cutting blades is damaged, the combination apparatus is disassembled by reversing the assembly steps and the damaged cutting blade is removed and replaced with a new cutting blade and reassembled onto the exterior surface of the propeller shaft.

Figure 11:
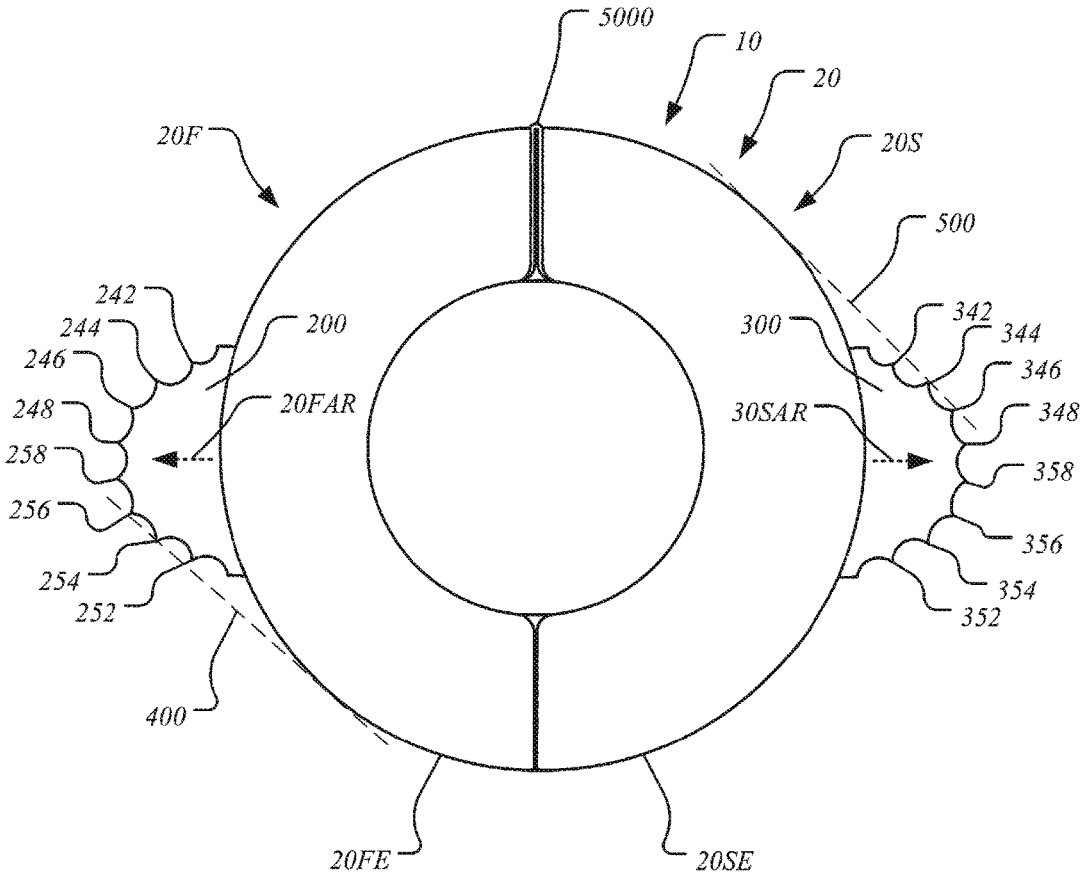
FIG. 11 is a top plan view of an alternative embodiment of the assembled present invention apparatus having a body made of sacrificial anode material and illustrating both cutting blades partially inserted through the body with the cutting teeth extending away from the body and an arrow in each cutting blade pointing in the direction that the blade was pushed after insertion, with the straight imaginary lines drawn in dashed lines and presented for illustrative purposes only, the arm illustrated on the left side is the first arm and the arm illustrated on the right side is a second arm, with both arms connected at one end by a hinge assembly and the arms connected at the opposite end in the manner referenced in FIG. 9 where a bolt is not visible.

The patent has been described where each of the two arms 20F and 20S are separate arms which are then affixed together by al of the apparatus as described above It is also within the spirit and scope of the present invention to have the two arms 20F and 20S connected by a rotatable member such as a hinge. Referring to FIG. 11, there is illustrated a top plan view of the assembled present invention apparatus having a body made of sacrificial anode materials and illustrating both cutting blades entirely inserted in the body with the cutting teeth extending away from the body with an arrow in each cutting blade pointing in the direction the cutting blade was pushed after insertion and two straight imaginary lines drawn in dashed lines presented for illustrative purposes. The first arm to the left ad the second arm to the right are connected at one of their adjoining faces by a rotatable hinge assembly so that it is not necessary to connect the two arms with a pair of bolt, but only necessary to connect the area that is not connected with a hinge with a separate bolt assembly.

It is also within the spirit and scope of the present invention to have the two arms connected at one side so that only one mating bolt is necessary and the mating threaded opening and smooth openings are eliminated on one side. The description for FIG. 11 is similar to the description for FIG. 8 but instead, two of the sides are attached by a hinge 5000. For example, referring to FIGS. 6A and 6B, respective flat side 20SI1 and flat side 20FI2 would be attached to each other with a hinge 5000 so that only two of the respective flat sides would need to be attached by a bolt. Alternatively, respective flat side 20SI2 and flat side 20FI1 would be the two sides which could be attached by the hinge assembly as described above. Assuming that the hinge assembly is attached using flat sides 20SI1 and 20FI2, then the opposite sides would be attached through the bolt assembly as previously described. This feature would eliminate the requirement of having two threaded openings and two smooth openings with two bolts but simply would have one side attached with a hinge with only one threaded opening and one smooth opening as described above. Of course, the hinge could be located either on mating flat surfaces 20SI1 and 20FI2 or flat surfaces 20SI12 and 20FI1. Either way, one arm would then be rotatable about the hinge so that instead of having to place the separate arms against the propeller shaft, the arms would be placed together with the hinge on one side and then the open ends on the second side connected with a single bolt such as 90S.

Figure 12:
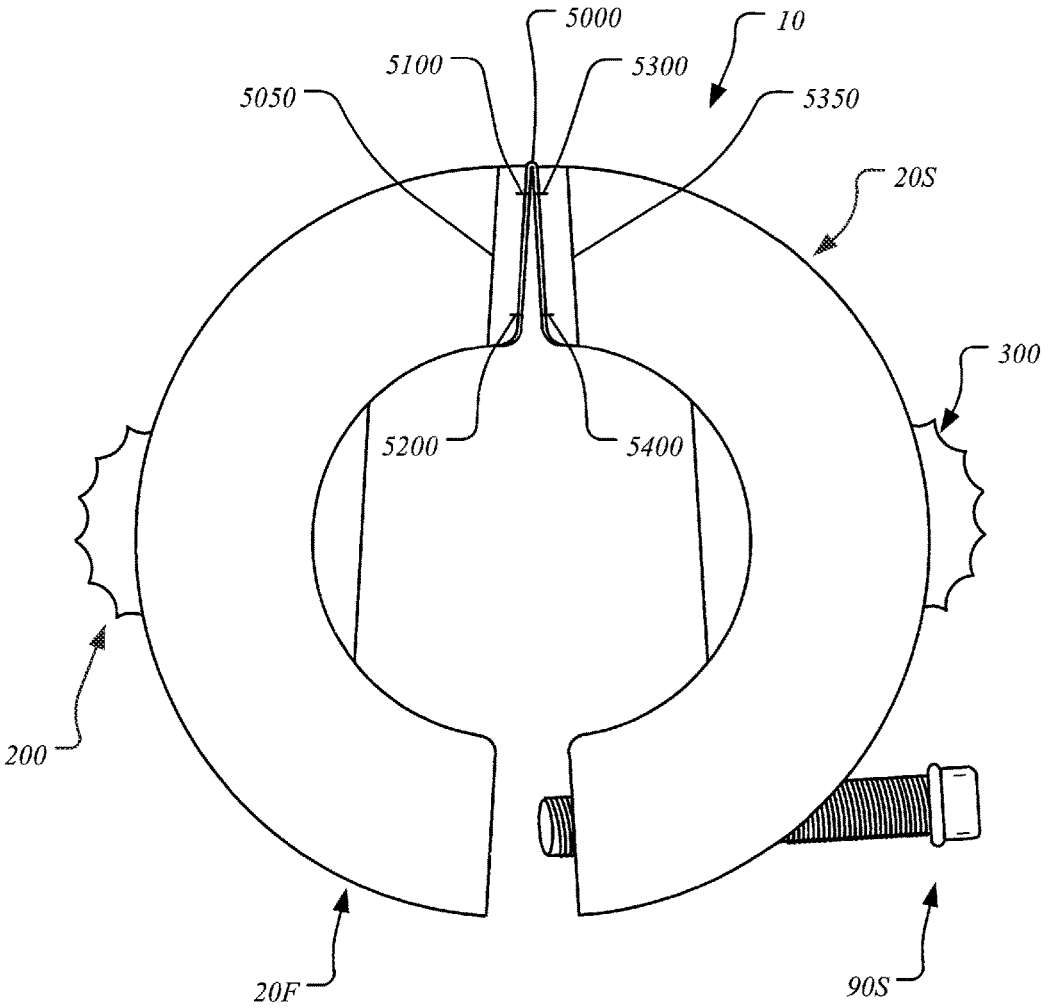
FIG. 12 is a top plan exploded view of the alternative embodiment of the present invention apparatus having a body made of sacrificial anode material and illustrating both cutting blades partially inserted in the body with the cutting teeth extending away from the body, only a single mating bolt connecting the two arms together and on the opposite end, a hinge assembly which is affixed to both arms to connect the two together and enable each arm to be rotatably moved relative to the other before insertion onto the shaft of a propeller.

FIG. 12 is a top plan exploded view of the present invention apparatus having a body made of sacrificial anode material and illustrating both cutting blades partially inserted in the body with the cutting teeth extending away from the body, only a single mating bolt connecting the two arms together and on the opposite end, a hinge assembly which is affixed to both arms to connect the two together and enable each arm to be rotatably moved relative to the other before insertion onto the shaft of a propeller. Specifically, the hinge assembly 5000 has a first plate 5050 with an attachment member 5100 and attachment member 5200 and a second plate 5350 with an attachment member 5300 and a second attachment member 5400 attaching the two arms together at one end. The two arms 20F and 20S can be rotated about the hinge 5000 so that it is only necessary to affix the two arms together with one bolt such as 90S in the manner previously described.

Figure 13:
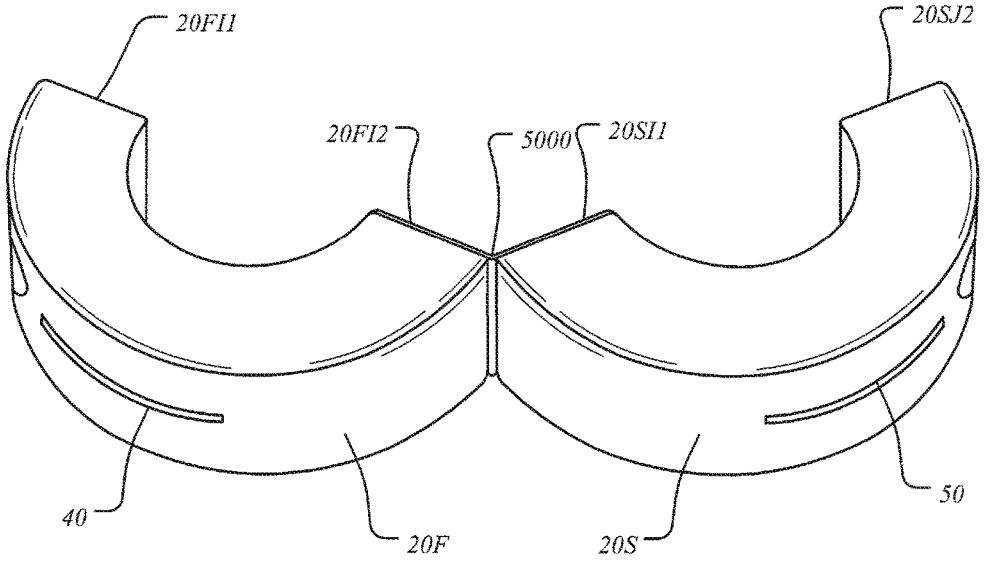
FIG. 13 is a perspective view of the first arm and second arm of the sacrificial anodes opened with the hinge showing the ends of the sacrificial anode which are not attached by the hinge as well as the ends of the sacrificial anodes which are attached by the hinge.

Referring to FIG. 13, there is illustrated a perspective view of the sacrificial anode in the opened condition where one sacrificial anode has been rotated relative to the other. FIG. 13 shows sacrificial anode 20F with slot 40 and flat faces 20FI1 and 20FI2. The hinge is numbered 5000 and sacrificial anode 20S has slot 50 and faces 20SI1 and 20SI2. The hinge connects spaces 20FI2 and 20SI1 and the other two faces are connected by the bolt 90S as illustrated in FIG. 12.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus adapted for use with a propeller shaft, the apparatus comprising:

a. a first cutting blade and an identical second cutting blade, the first and second cutting blades each formed with a flat upper surface and a spaced apart identical flat lower surface, a sidewall of uniform thickness between the flat upper surface and the identical flat lower surface, a proximal end with a first width extending to a body with spaced apart first sidewall and second sidewall, extending to a teeth section having a first multiplicity of cutting teeth extending from the first sidewall and a second multiplicity of cutting teeth extending from the second sidewall, each respective tooth from the first multiplicity of teeth aligned with a respective tooth from the second multiplicity of teeth;

b. a first arm made of sacrificial anode material and formed in a thick C-shape having a body with a semi-circular exterior sidewall and a semi-circular interior sidewall, a first smooth interior wall extending from a first recess in the exterior sidewall to an interior smooth opening with an extension protruding from a first flat interior wall and a first threaded opening extending from a second recess in the exterior sidewall to an interior threaded opening recessed inwardly from a second flat interior surface, a first transverse slot extending from a proximal opening at the first interior sidewall to a distal opening at the first exterior sidewall, the first slot between the first smooth opening and the first threaded opening;

c. a first cutting blade removably inserted at the proximal end of the first slot and extending through the body of the first arm, the multiplicity of cutting teeth protruding away from the exterior sidewall of the first arm, a portion of a first multiplicity of cutting teeth aligned with a first slope relative to the exterior surface of the first arm and a portion of the second multiplicity of cutting teeth aligned with a second slope relative to the exterior surface of the first arm;

d. a second arm made of sacrificial anode material and formed in a thick C-shape having a body with a semi-circular exterior sidewall and a semi-circular interior sidewall, a first smooth interior wall extending from a third recess in the exterior sidewall to an interior smooth opening with an extension protruding from a third flat interior wall and a second threaded opening extending from a fourth recess in the exterior sidewall to an interior threaded opening recessed inwardly from a fourth flat interior surface, a second transverse slot extending from a proximal opening at the second interior sidewall to a distal opening at the second exterior sidewall, the second slot between the second smooth opening and the second threaded opening;

e. a second cutting blade removably inserted at the proximal end of the second slot and extending through the body of the second arm, the multiplicity of cutting teeth protruding away from the exterior sidewall of the second arm, a portion of a first multiplicity of cutting teeth aligned with a first slope relative to the exterior surface of the second arm and a portion of the second multiplicity of cutting teeth aligned with a second slope relative to the exterior surface of the second arm;

f. the first arm and the second arm removably joined together with the first smooth opening aligned with the second threaded opening, the extension from the first smooth opening inserted into the recess of the second threaded opening, and the first threaded opening aligned with the second smooth opening, the extension from the second smooth opening inserted into the recess of the first threaded opening, a first mating bolt extending through the first smooth opening and threaded into the second threaded opening and a second mating bolt extending through the second smooth opening and threaded through the first threaded opening; and g. the joined first and second arms forming a body with an interior diameter created from the first and second interior sidewalls press fit retained against an exterior wall of a cylindrical-shaped propeller shaft and the sloped relationship between the cutting blades and the combined first and second exterior sidewalls provide a smooth cutting action and the first and second arms rotate with the propeller shaft.

2. The apparatus in accordance with claim 1, further comprising: the sacrificial anode material is selected from the group consisting of zinc and magnesium.

3. An apparatus adapted for use with a propeller shaft, the apparatus comprising:

a. a first cutting blade and an identical second cutting blade, the first and second cutting blades each formed with a flat upper surface and a spaced apart identical flat lower surface, a body having a proximal end and a distal end, the body including a teeth section having a first multiplicity of cutting teeth and a spaced apart second multiplicity of cutting teeth, b. a first arm made of sacrificial anode material and formed in a thick C-shape having a body with a semi-circular exterior sidewall and a semi-circular interior sidewall, a first smooth interior wall extending from a first recess in the exterior sidewall to an interior smooth opening, a first threaded opening extending from a second recess in the exterior sidewall to an interior threaded opening, a first transverse slot extending from a proximal opening at the first interior sidewall to a distal opening at the first exterior sidewall, the first slot between the first smooth opening and the first threaded opening;

c. a first cutting blade removably inserted at the proximal end of the first slot and extending through the body of the first arm, the multiplicity of cutting teeth protruding away from the exterior sidewall of the first arm, at least a portion of a first multiplicity of cutting teeth aligned with a first slope relative to the exterior surface of the first arm;

d. a second arm made of sacrificial anode material and formed in a thick C-shape having a body with a semi-circular exterior sidewall and a semi-circular interior sidewall, a first smooth interior wall extending from a third recess in the exterior sidewall to an interior smooth opening and a second threaded opening extending from a fourth recess in the exterior sidewall to an interior threaded opening, a second slot having a proximal opening at the second interior sidewall to a distal opening at the second exterior sidewall, the second slot between the second smooth opening and the second threaded opening;

e. a second cutting blade removably inserted at the proximal end of the second slot and extending through the body of the second arm, the multiplicity of cutting teeth protruding away from the exterior sidewall of the second arm, at least a portion of a first multiplicity of cutting teeth aligned with a first slope relative to the exterior surface of the second arm;

f. the first arm and the second arm removably joined together with the first smooth opening aligned with the second threaded opening, and the first threaded opening aligned with the second smooth opening, a first mating threaded bolt extending through the first smooth opening and threaded into the second threaded opening and a second mating threaded bolt extending through the second smooth opening and threaded through the first threaded opening; and g. the joined first and second arms forming a body with an interior diameter created from the first and second interior sidewalls press fit retained against an exterior wall of a cylindrical-shaped propeller shaft and the sloped relationship between the cutting blades and combined first and second exterior sidewalls provide a smooth cutting action and the first and second arms rotate with the propeller shaft.

4. The apparatus in accordance with claim 3, further comprising: the sacrificial anode material is selected from the group consisting of zinc, aluminum and magnesium or a mixture of sacrificial metals.

5. An apparatus adapted for use with a propeller shaft, the apparatus comprising:

a. a first cutting blade and an identical second cutting blade, the first and second cutting blades each formed with a flat upper surface and a spaced apart identical flat lower surface, a body having a proximal end and a distal end, the body including a teeth section having a first multiplicity of cutting teeth and a spaced apart second multiplicity of cutting teeth;

b. a first arm made of sacrificial anode material and formed in a thick C-shape having a body with a semi-circular exterior sidewall and a semi-circular interior sidewall, at least one passage extending through the first arm and at least a first slot extending through the first arm;

c. a first cutting blade removably inserted through the at least one slot in the first arm, the multiplicity of cutting teeth protruding away from the exterior sidewall of the first arm, at least a portion of a first multiplicity of cutting teeth aligned with a first slope relative to the exterior surface of the first arm;

d. a second arm made of sacrificial anode material and formed in a thick C-shape having a body with a semi-circular exterior sidewall and a semi-circular interior sidewall, at least one passage extending through the second arm and at least a second slot extending through the second arm;

e. a second cutting blade removably inserted through the at least one slot in the second arm, the multiplicity of cutting teeth protruding away from the exterior sidewall of the second arm, at least a portion of a first multiplicity of cutting teeth aligned with a first slope relative to the exterior surface of the first arm;

f. the first arm and the second arm removably joined together with a joining member extending through the at least one passage in the first arm and extending through and aligned at least one passage in the second arm; and g. the joined first and second arms forming a body with an interior diameter created from the first and second interior sidewalls press fit retained against an exterior wall of a cylindrical-shaped propeller shaft and the sloped relationship between the at least a portion of the cutting blades and at least the first exterior sidewall provides a smooth cutting action and the first and second arms rotate with the propeller shaft.

6. The apparatus in accordance with claim 5, further comprising: the sacrificial anode material is selected from the group consisting of zinc, aluminum and magnesium or a mixture of sacrificial metals.

7. An apparatus adapted for use with a propeller shaft, the apparatus comprising:

a. a first cutting blade and an identical second cutting blade, the first and second cutting blades each formed with a flat upper surface and a spaced apart identical flat lower surface, a sidewall of uniform thickness between the flat upper surface and the identical flat lower surface, a proximal end with a first width extending to a body with spaced apart first sidewall and second sidewall, extending to a teeth section having a first multiplicity of cutting teeth extending from the first sidewall and a second multiplicity of cutting teeth extending from the second sidewall, each respective tooth from the first multiplicity of teeth aligned with a respective tooth from the second multiplicity of teeth;

b. a first arm made of sacrificial anode material and formed in a thick C-shape having a body with a semi-circular exterior sidewall and a semi-circular interior sidewall, a first smooth interior wall extending from a first recess in the exterior sidewall to an interior smooth opening with an extension protruding from a first flat interior wall, a first transverse slot extending from a proximal opening at the first interior sidewall to a distal opening at the first exterior sidewall, and a second smooth surface on the first arm;

c. a first cutting blade removably inserted at the proximal end of the first slot and extending through the body of the first arm, the multiplicity of cutting teeth protruding away from the exterior sidewall of the first arm, a portion of a first multiplicity of cutting teeth aligned with a first slope relative to the exterior surface of the first arm and a portion of the second multiplicity of cutting teeth aligned with a second slope relative to the exterior surface of the first arm;

d. a second arm made of sacrificial anode material and formed in a thick C-shape having a body with a semi-circular exterior sidewall and a semi-circular interior sidewall, and a first threaded opening extending from a second recess in the exterior sidewall to an interior threaded opening recessed inwardly from the second flat interior surface, a second transverse slot extending from the proximal opening at the second interior sidewall to a distal opening at the second exterior sidewall, the second arm also having a second smooth surface;

e. a second cutting blade removably inserted at the proximal end of the second slot and extending through the body of the second arm, the multiplicity of cutting teeth protruding away from the exterior sidewall of the second arm, a portion of a first multiplicity of cutting teeth aligned with a first slope relative to the exterior surface of the second arm and a portion of the second multiplicity of cutting teeth aligned with a second slope relative to the exterior surface of the second arm; and f. the first arm and the second arm rotatably joined together by a hinge having a hinge plate affixed at one side to the second smooth surface of the first arm and having a hinge plate affixed at a second side to the first smooth surface of the second arm with a hinge between the hinge plates to rotatably attach the first arm to the second arm through a rotatable hinge mechanism, further, then the first smooth opening aligned with the first threaded opening, the extension from the first smooth opening inserted into the recess of the first threaded opening, and a mating bolt extending through the first smooth opening and threaded into the first threaded opening to join together the sides of the arm opposite to the side where the hinge is located; and g. the joined first and second arms forming a body with an interior diameter created from the first and second interior sidewalls press fit retained against an exterior wall of a cylindrical-shaped propeller shaft and the sloped relationship between the cutting blades and the combined first and second exterior sidewalls provide a smooth cutting action and the first and second arms rotate with the propeller shaft.

8. The apparatus in accordance with claim 7, further comprising: the sacrificial anode material is selected from the group consisting of zinc, aluminum and magnesium or a mixture of sacrificial metals.

* * * * *